US005624041A

United States Patent [19]

Van Druff, Jr. et al.

[11] Patent Number: 5,624,041

[45] Date of Patent: Apr. 29, 1997

[54] HAT DISPLAY

[75] Inventors: Albert F. Van Druff, Jr., Lawrenceville; Richard M. Fossum, Jr., Atlanta, both of Ga.

[73] Assignee: Cornerstone Products, Inc., Norcross, Ga.

[21] Appl. No.: 287,279

[22] Filed: Aug. 8, 1994

[51] Int. Cl.[6] ..... A47F 7/06

[52] U.S. Cl. ..... 211/30; 211/33; 223/24

[58] Field of Search ..... 211/30, 31, 32, 211/33; 248/174, 152; 223/24, 25, 26, 84

[56] References Cited

U.S. PATENT DOCUMENTS

| | | | |
|---|---|---|---|
| D. 115,870 | 7/1939 | Jacobius | 211/30 X |
| 1,050,113 | 1/1913 | Eichelkraut | 248/174 X |
| 1,083,805 | 1/1914 | Conrad | 211/32 |
| 2,107,178 | 2/1938 | Fackler | 211/33 |
| 2,494,487 | 1/1950 | Pfeil | 211/32 |
| 3,501,072 | 3/1970 | Kovener | 223/84 X |
| 5,121,842 | 6/1992 | Osborne | 211/33 |
| 5,161,719 | 11/1992 | Otteson et al. | 223/24 |
| 5,240,123 | 8/1993 | Hawk | 211/32 |
| 5,303,829 | 4/1994 | Kennedy | 211/33 X |

FOREIGN PATENT DOCUMENTS

| | | | |
|---|---|---|---|
| 46398 | 1/1920 | Sweden | 211/33 |

*Primary Examiner*—Korie Chan
*Attorney, Agent, or Firm*—Aquilino & Welsh

[57] ABSTRACT

The present invention relates to a display for billed caps which functions to suspend a cap either above a counter top via a cross-shaped base or via a string in order to rotate while operating to display a cap. The display includes first and second paperboard members which are interlocked via slots to form a skeleton crown supporting frame disposed interiorly of the cap and a suspension system located exteriorly above or below the cap to be displayed. The skeleton crown supporting frame functions to maintain the crown of the cap to be displayed in an appealing expanded state.

18 Claims, 2 Drawing Sheets

HAT DISPLAY

BACKGROUND OF THE INVENTION

1. Field of the Invention

The present invention relates to a hat display and more particularly to a display for suspending baseball type caps.

It has become very popular for people to collect baseball caps or other novelty billed caps. In view of the demand for these types of hats, retailers and individuals are desirous of displaying the caps in a neat and attractive manner. Further, retailers are interested in attracting customers to the area of the store where these types of caps are sold.

Consequently, the need for a new type of hat display has arisen which is inexpensive, eye catching and will maintain the proper shape of the cap. To meet this need, the present invention of a suspension type cap display was developed.

SUMMARY OF THE INVENTION

The present invention involves a hat display which may hang from a ceiling or other raised surface of via a string in order to rotate 360° while displaying the cap and a hat display which suspends a cap above a counter top. The invention includes a crown supporting frame which is positioned interiorly of the cap and a suspension system in combination therewith which is positioned exteriorly of the cap. More specifically, the display includes a first vertically disposed paperboard section with a crown supporting portion and a cap suspending portion, a second vertically disposed paperboard section, perpendicular to the first paperboard section, which is interlocked with the crown supporting portion via registered slots in order to form a skeleton frame which supports the cap's crown in a fully extended manner.

Accordingly, it is an object of this invention to provide a hat mobile which will display billed caps in an aesthetically pleasing fashion while maintaining its proper shape.

It is a further object of the invention to provide a hat display which can rotate 360° while being suspended from a ceiling or other raised surface in order to attract attention.

Still another object of the invention is to provide a counter top display which suspends the crown of a baseball cap above a horizontal surface.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 3:
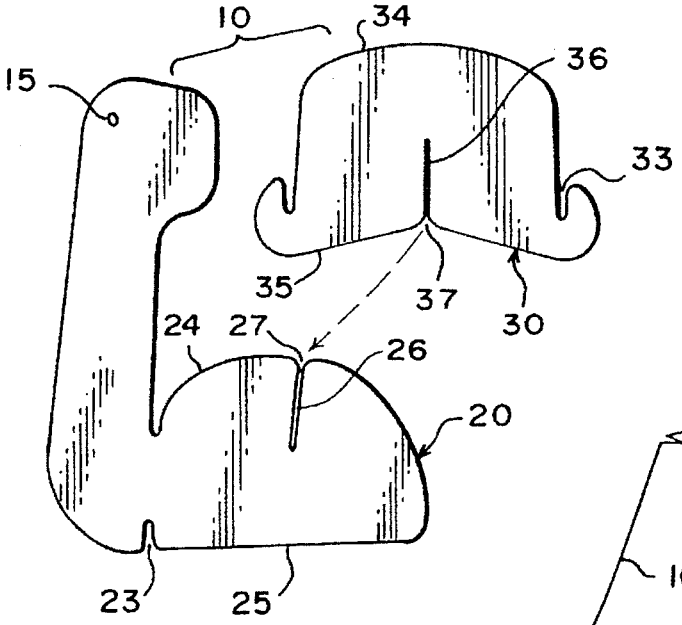
FIG. 3 is a side view of the components of the cap display in an unassembled state.
Figure 2:
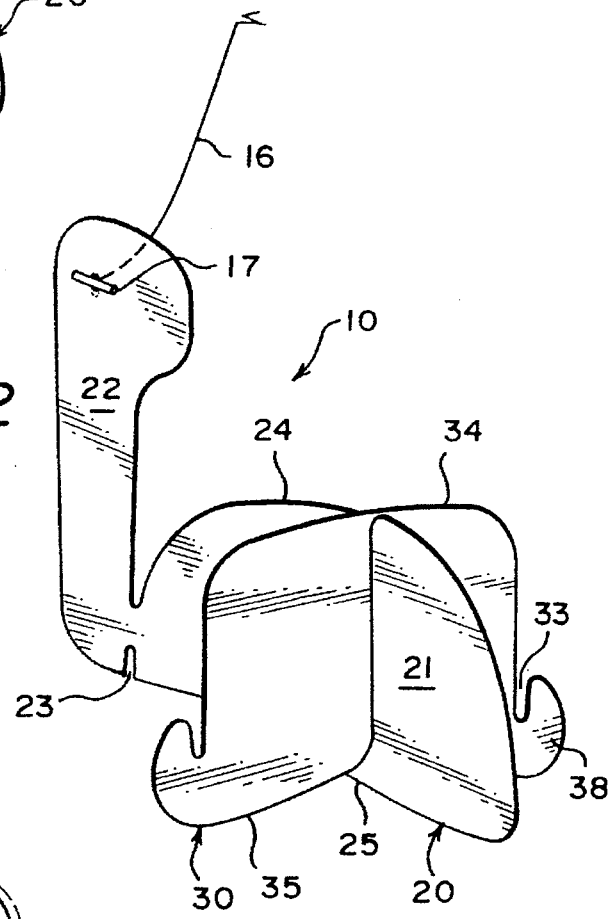
FIG. 2 is a perspective view of an assembled cap display of the present invention.
Figure 1:
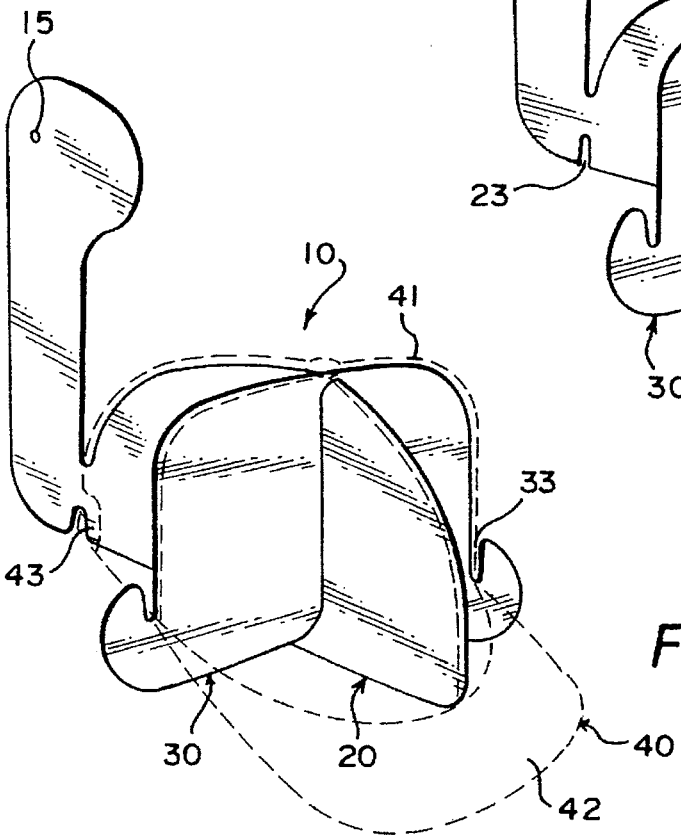
FIG. 1 is a perspective view of the cap display with a cap shown in dotted lines mounted thereon in accordance with the present invention.

FIGS. 1–3 illustrate the preferred embodiment of the invention. FIG. 3 shows the display 10 in an unassembled form. FIG. 2 shows the display 10 fully assembled and FIG. 1 shows the display in operation with a cap 40 shown in broken lines thereon. Cap 40 includes a crown 41, a bill 42 and an adjustment band 43. The display 10 includes a first vertical paperboard member 20 which is planar and interlocked with a second vertical paperboard member 30 which is also planar as best shown in FIG. 2. When assembled, the first vertical paperboard member is interlocked perpendicular to the second vertical paperboard member.

The first vertical member 20 includes a crown supporting portion 21 and a cap suspending portion 22 extending upwardly above the crown supporting portion 21. The cap suspending portion 22 includes an opening 15 which cooperates with a string 16 having a rod 17 attached at one end thereof to form a suspension means which allows the display to rotate, much like a mobile. The crown supporting portion 21 includes a slot 26. The upper edge 24 of said crown supporting portion 21 is shaped to conform to the interior of the crown 41 of the cap 40 to be displayed, which in FIG. 1 is shown to be curved in a convex manner. The bottom edge 25 may be curved upwardly toward the upper edge 24 in order to be completely hidden within the cap 40 displayed thereon. Located at the rear of the crown supporting portion is a slot 23 which engages the adjustment band 43 of one size fits all caps. Slot 23 separates the cap suspending portion 22 from the crown supporting portion 21 and functions in combination with slots 33 on the second vertical member to retain the cap on the skeleton frame formed by crown supporting portion 21 and second vertical member 30. It should be understood that the cap suspending portion could be attached to the second vertical paperboard member, without departing from the spirit of the present invention.

The second vertical member 30 includes a central slot 36 which cooperates with slot 26 on said first vertical member 20 in order to interlock the members together. The second vertical member 30 also includes rim retaining slots 33 which are spaced from one another by the width of cap 40. The upper edge 34 of second vertical member 30 is also curved to conform to the interior shape of the crown 41 of the cap to be displayed. The bottom edges 35 and 37 taper upwardly and inwardly toward slot 36, thus all but portions 38 which extend laterally outward from slots 33 are hidden when the cap 40 is displayed. The mouth portion of slots 26 and 36 is widened at 27 and 37, respectively, in order to facilitate the interlocking between members.

The dimensions of the crown supporting portion 21 and second vertical member 30 are such that they are disposed interiorly of the crown 40 to engage the interior surface of the crown in order to expand the crown 40, thus shaping the outward appearance of the crown. Portion 38 which is not interiorly of the cap 40 is optional depending upon whether rim retaining slots are desired.

In operation, members 20 and 30 would first be interlocked perpendicular together via slots 26 and 36. Then the cap 40 to be displayed with its one size fits all adjustment band 43 unassembled would be positioned on upper edges 24 and 34 of the crown supporting frame. The side rims of the cap would be fitted into slots 33 and then the rear adjustment band 43 would be connected together and fitted up into slot 23. Since slot 23 opens downwardly and slots 33 open upwardly, the cap is thereby retained in a secure fully expanded position on the crown supporting frame of the hat display 10.

Figure 4:
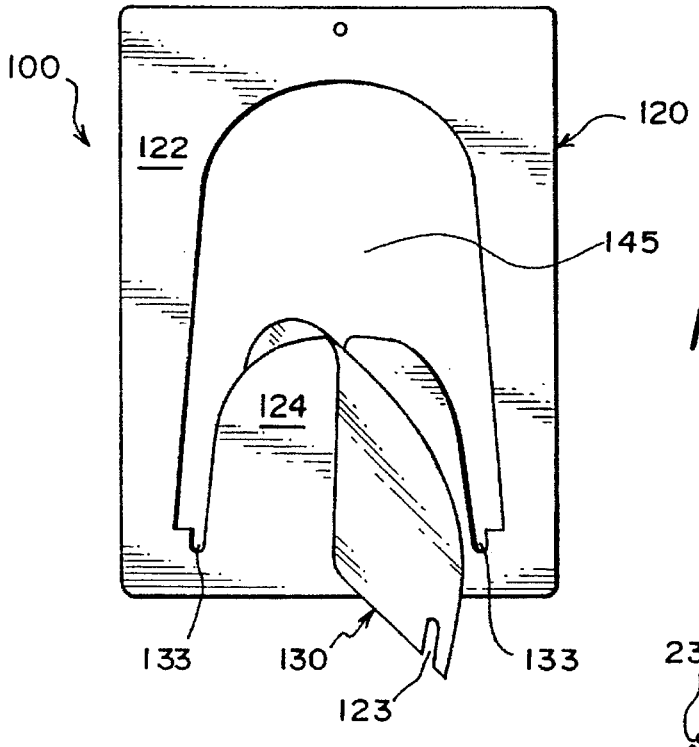
FIG. 4 is a rear perspective view of another embodiment of the present invention.

FIG. 4 shows a second embodiment 100 having a first vertical member 120 and a second vertical member 130 interlock with and perpendicular to the first vertical member. The first vertical member 120 includes a cap suspending portion 122 and a crown supporting portion 124. In this embodiment, the first vertical member includes rim retaining slots 133 and the second vertical member includes the adjustment band retaining slot 123. The first vertical member 120 starts off as a square or rectangular piece of paperboard. The cut out area 145 is then removed to form the crown supporting portion with upper edge 124 and rim retaining slots 133.

Figure 5:
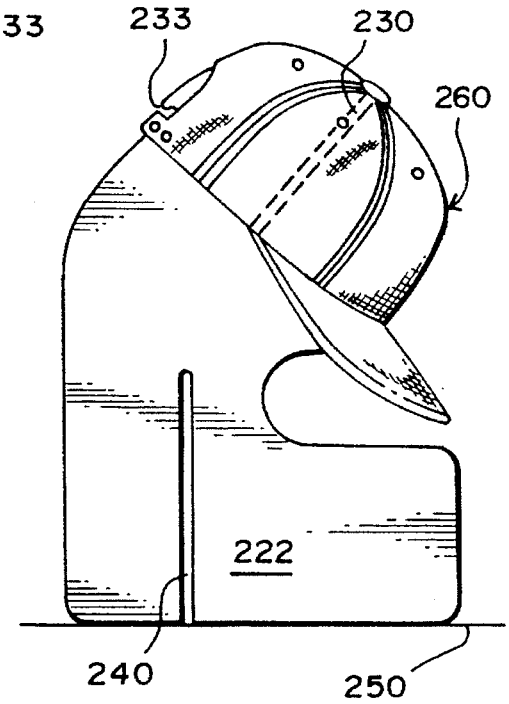
FIG. 5 is a side view of a counter top display embodiment of the, present invention with a cap displayed thereon.
Figure 6:
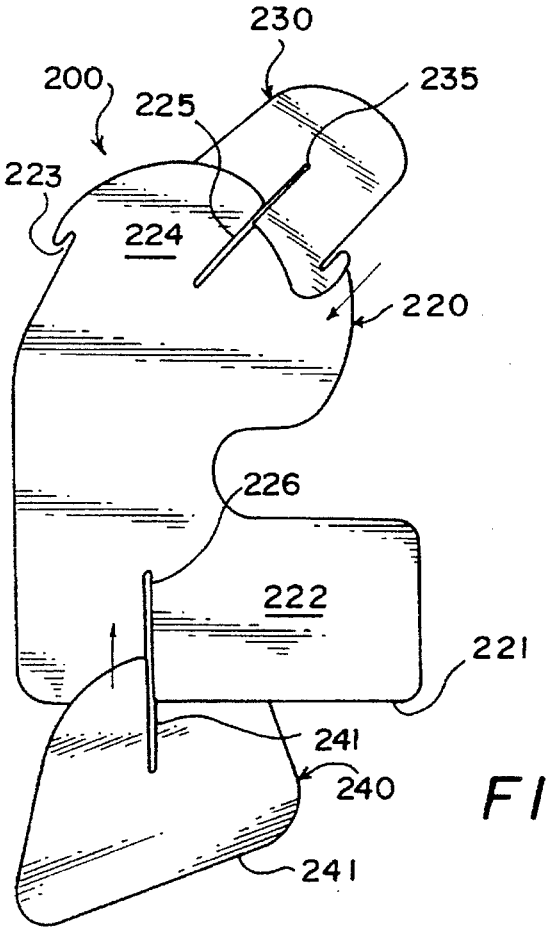
FIG. 6 is a side perspective showing the assembly of the counter top display embodiment.

FIGS. 5 and 6 show a counter top embodiment 200 including a first vertical member 220 and a second vertical member 230 interlock with and perpendicular to the first vertical member. The first vertical member 220 includes a cap suspending portion 222 and a crown supporting portion 224. The crown supporting portion 224 includes an adjustment band retaining slot 223 and a slot 225 which cooperates with a slot 235 in the second vertical member 230 in order to interlock the first and second members together to form a skeleton crown supporting frame. The cap suspending portion 222 includes a slot 241 which interlocks with slot 246 in a third vertical member 240 to form a cross-shaped base suspension means which functions to suspended the displayed cap above a horizontal counter top 250. The cross-shaped base is formed by horizontal bottom edge 241 of the third vertical member 240 which lies in the same plane as the horizontal bottom edge 221 of the first vertical member 220 when slots 226 and 246 are assembled together. The cap suspending portion 222 extends underneath the crown supporting portion 224 in order to add stability to the display 200. As shown in this embodiment the second vertical member 230 is perpendicular to the first vertical member 220 when slots 225 and 235 are interlocked to cooperate with one another. When the first and second vertical members are interlocked together they form a skeleton crown supporting frame which is adapted to be disposed interiorly the crown of the cap to be displayed. As shown in FIG. 5 the second vertical member is completely disposed under the hat 260 and thus does not include any rim engaging slots. It should be understood that the rim engaging slots are optional on all embodiments.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

We claim:

1. A display for a hat comprising:

a first vertical member with a crown supporting portion and a cap suspending portion extending above said crown supporting portion;

a second vertical member perpendicular to said first member; and, said crown supporting portion of said first member and said second member each including a slot which cooperate with one another to interlock the members together and form a frame which is adapted to be disposed interiorly of the hat in order to maintain the hat's crown fully extended; and wherein one of said first vertical member or said second vertical member includes a slot for receiving an adjustment band located at the rear of the hat to be displayed.

2. The invention as set forth in claim 1, wherein said first and second members include slots for receiving portions of the hat to be displayed.

3. The invention as set forth in claim 1, wherein said cap suspending portion of said first member includes a suspension string attached thereto.

4. The invention as set forth in claim 1, wherein the upper edges of said crown supporting portion and said second member are curved adapted to conform to the shape of the interior of the crown of the hat to be displayed.

5. The invention as set forth in claim 1, wherein the slots are wider at their mouths to facilitate their interlocking.

6. The invention as set forth in claim 1, wherein said first and second members are manufactured from planar paperboard materials.

7. A display for a hat comprising:

a first planar member with a crown supporting portion;

a second planar member connected to said crown supporting portion of said first planar member so as to be perpendicular thereto, wherein said crown supporting portion and said second planar member form a skeleton crown supporting frame which is adapted to be disposed interiorly of the hat to be displayed to directly support the hat;

a suspension means for suspending said skeleton crown supporting frame; said suspension means being attached to said first planar member so as to extend above said skeleton crown supporting frame; and wherein one of said first planar member or said second planar member includes a slot for receiving an adjustment band located at the rear of the hat to be displayed.

8. The invention as set forth in claim 7, wherein said first and second members include slots for receiving portions of the hat to be displayed.

9. The invention as set forth in claim 7, wherein the upper edges of said crown supporting portion and said second member are curved adapted to conform to the shape of the interior of the crown of the hat to be displayed.

10. The invention as set forth in claim 7 wherein said first and second members are manufactured from paperboard materials.

11. The invention as set forth in claim 7, wherein the first and second members are connected together via interlocking slots.

12. The invention as set forth in claim 11, wherein the slots are wider at their mouths to facilitate their interlocking.

13. The invention as set forth in claim 7, wherein suspension means is integrally formed with said first member.

14. The invention as set forth in claim 13 wherein said first planar member includes a cut-out area between said crown supporting portion and said suspension means.

15. A display for a hat comprising:

a first planar member with a crown supporting portion;

a second planar member connected to said crown supporting portion of said first planar member so as to be perpendicular thereto, wherein said crown supporting portion and said second planar member form a skeleton crown supporting frame which is adapted to be disposed interiorly of the hat to be displayed to directly support the hat;

a suspension means attached to said skeleton crown supporting frame for suspending said skeleton crown supporting frame/and wherein one of said first planar member or said second member includes a slot for receiving an adjustment band located at the rear of the hat to be displayed.

16. The invention as set forth in claim 15 wherein said suspension means is attached to said first planar member so as to extend above said skeleton crown supporting frame.

17. The invention as set forth in claim 15 wherein said suspension means is attached to said first planar member so as to extend below said skeleton crown supporting frame.

18. The invention of claim 15 wherein said suspension means includes a third planar member having a slot which is connected to a slot in said first planar member so as to be perpendicular thereto, thereby forming a cross-shaped base which is adapted to rest upon a counter top.

* * * * *